US006215385B1

(12) United States Patent
Ogden

(10) Patent No.: US 6,215,385 B1
(45) Date of Patent: Apr. 10, 2001

(54) IGNITION COIL WITH PRIMARY WINDING OUTSIDE OF SECONDARY WINDING

(75) Inventor: Jeffrey Dan Ogden, Anderson, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/438,876

(22) Filed: Nov. 12, 1999

(51) Int. Cl.[7] ..... H01F 27/02
(52) U.S. Cl. ..... 336/96; 336/90; 123/634
(58) Field of Search ..... 336/90, 92, 96; 123/634, 635

(56) References Cited

U.S. PATENT DOCUMENTS

| | | | | |
|---|---|---|---|---|
| 4,903,674 | | 2/1990 | Bassett et al. . | |
| 5,128,645 | * | 7/1992 | Suda | 336/110 |
| 5,146,882 | | 9/1992 | Brinkman et al. . | |
| 5,703,556 | * | 12/1997 | Kikuta et al. | 336/83 |
| 5,706,792 | * | 1/1998 | Boyer et al. | 123/634 |
| 5,758,624 | | 6/1998 | Satou et al. . | |
| 5,778,863 | * | 7/1998 | Oosuka et al. | 123/634 |
| 5,870,012 | | 2/1999 | Sakamaki et al. . | |
| 5,977,856 | * | 11/1999 | Maekawa et al. | 336/96 |
| 6,114,935 | * | 9/2000 | Oosuka et al. | 336/107 |

* cited by examiner

*Primary Examiner*—Anh Mai
(74) *Attorney, Agent, or Firm*—Margaret A. Dobrowitsky

(57) ABSTRACT

An ignition coil has concentrically arranged components including a core, a secondary winding spool adjacent to the core, a secondary winding wound on the spool, a case made of electrical insulating material, a primary winding wound on an outer surface of the case, and a shield disposed radially outwardly of the primary winding. The case is configured so as to allow the primary winding to be wound thereon and to space the shield a predetermined space from the primary winding. A radially inner surface of the case and a radially outer portion of the secondary winding define a single potting channel for receiving an epoxy potting material. The configuration eliminates the primary winding spool, which reduces material cost, and further eliminates the effective dielectric contribution of the primary winding spool for reduced capacitance to thereby provide improved secondary winding output.

9 Claims, 1 Drawing Sheet

IGNITION COIL WITH PRIMARY WINDING OUTSIDE OF SECONDARY WINDING

BACKGROUND OF THE INVENTION

1. Technical Field

This invention relates generally to an ignition coil for use in producing a spark across a gap of a spark plug in an internal combustion engine, and more particularly, to an ignition coil having a primary winding disposed outwardly of a secondary winding.

2. Discussion of the Related Art

Known ignition coils utilize primary and secondary windings and a magnetic circuit. The magnetic circuit portion has taken a wide variety of configurations, and is typically constructed using magnetically-permeable material, such as steel laminations or compression molded insulated iron particles. One configuration known in the art comprises an elongated, generally cylindrical core.

This slender core is known to be used for so-called "pencil coils," useful in space limited engine configurations. In such a "pencil" coil, a number of components are typically concentrically arranged and include, from inside to outside, a core, a primary winding wound around the core, a secondary spool made of insulating material spaced from the primary winding, a secondary winding wound on the spool, a case formed of insulating material, and a shield formed of electrically conductive material and generally grounded. It is further known in the foregoing configuration to fill a first potting channel defined between the primary winding and an inside diameter of the secondary winding spool with epoxy potting material (i.e., dielectric material), and further, to fill a second potting channel defined between the secondary winding and an inside diameter of the case with epoxy potting material. The potting process for this configuration therefore involves filling two potting channels with potting material.

Another known configuration includes the following components, also generally concentrically arranged, in order from inside to outside, a core, a secondary winding spool made of insulating material, a secondary winding wound on the secondary winding spool, a primary winding spool, a primary winding wound on the primary winding spool, a case made from electrical insulating material, and a shield (grounded). This known configuration also includes two potting channels, namely, the annular space between the secondary winding and an inside diameter of the primary winding spool, and, the annular space between the primary winding and an inside diameter of the case. The potting process for this configuration thus also involves the filling of two potting channels. In addition, three principal dielectric barriers exist between the shield and the core, namely, the case, the wall of the primary winding spool, and the wall of the secondary winding spool (in addition to the epoxy potting material which makes some dielectric contribution). The increased capacitance resulting from the dielectric barriers impacts the secondary voltage performance (i.e., the voltage characteristics delivered to the spark plug). Since the form factor of the above-described configurations (i.e., slender form factor) is useful, it would be desirable to improve upon the foregoing.

Thus, there is a need to provide an improved ignition coil that minimizes or eliminates one or more of the shortcomings as set forth above.

SUMMARY OF THE INVENTION

An ignition coil in accordance with the present invention is configured to allow improved manufacture thereof by having only one potting channel (i.e., eliminating the second potting channel). In addition, the inventive ignition coil configuration reduces manufacturing costs due to the elimination of a primary winding spool. Moreover, an ignition coil according to the invention minimizes capacitance by eliminating a principal dielectric barrier (i.e., the primary winding spool), which yields improved secondary voltage performance.

As to the particular configuration, an ignition coil in accordance with the present invention includes a core, a secondary winding spool, a secondary winding wound on the spool, a case, a primary winding wound on the case, and a shield. The core may be generally elongated, comprise magnetically-permeable material, and have a main, longitudinal axis associated therewith. The secondary winding spool is disposed adjacent to and radially outwardly from the core. The case is formed of electrical insulating material and is spaced radially outwardly from the spool. The case has a configuration suitable for receiving a primary winding wound therearound. In particular, the case has an inner surface, an outer surface, an upper annular shoulder, and a lower annular shoulder. The primary winding, advantageously, is wound on a portion of the outer surface between the upper and lower annular shoulders, thereby eliminating the need for a primary winding spool. The shield is disposed radially outwardly from the primary winding, is electrically conductive, and is preferably grounded.

By disposing the primary winding on the outer surface of the case, the case may be configured so that epoxy potting material need only be disposed in one potting channel namely, between the inner surface of the case and the secondary winding. Elimination of the second potting channel found in conventional configurations improves the potting process that is required for manufacture of the ignition coil. In addition, the case and the primary winding spool found in conventional configurations have been integrated into the case alone in the present invention, thereby eliminating the need for a separate primary winding spool. This results in an reduced cost ignition coil.

Other objects, features, and advantages of the present invention will become apparent to one skilled in the art from the following detailed description and accompanying drawings illustrating features of this invention by way of example, but not by way of limitation.

DETAILED DESCRIPTION OF THE PREFERRED EMBODIMENT

Figure 1:
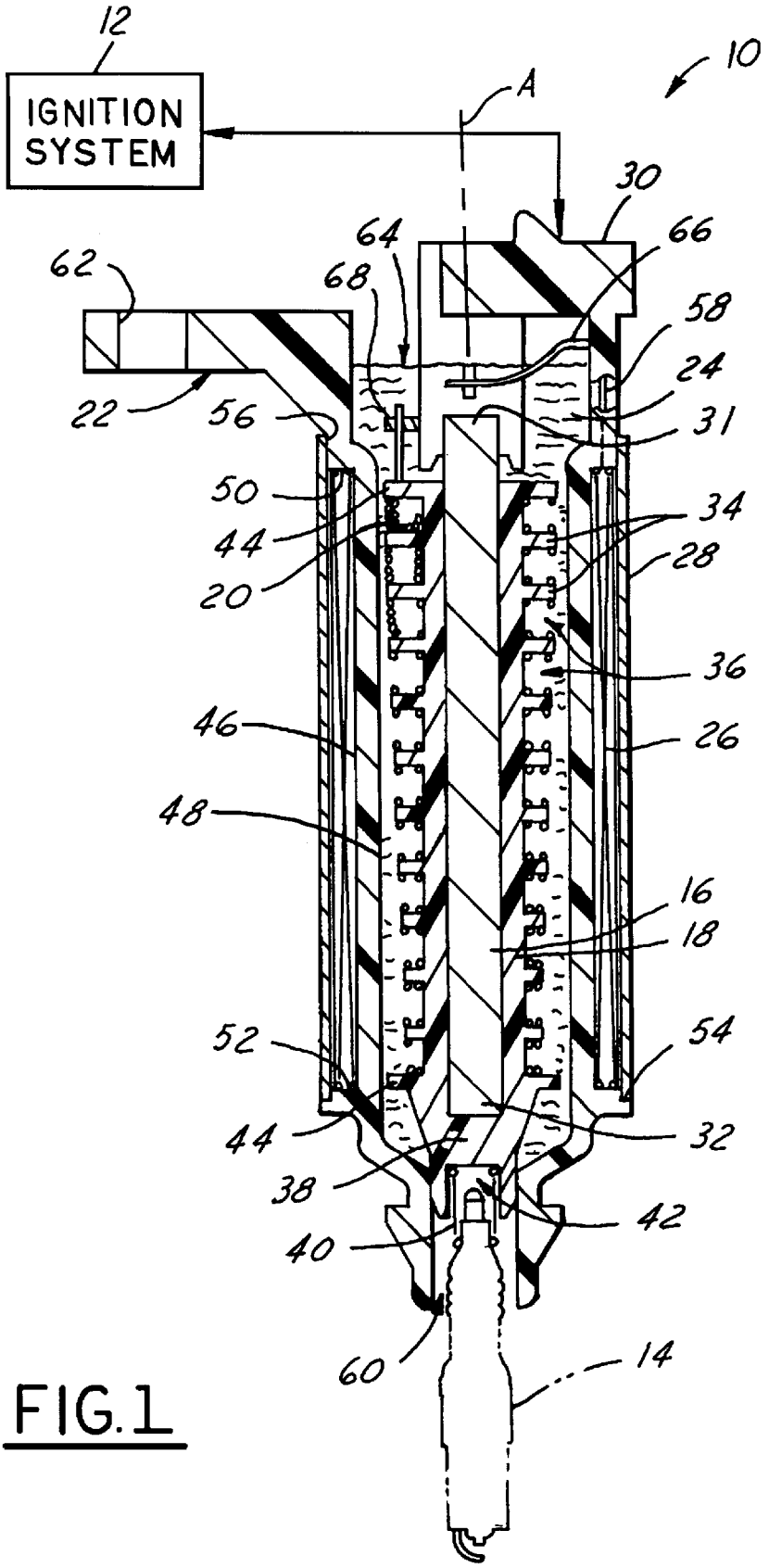
FIG. 1 is a simplified cross-section view of an ignition coil in accordance with the present invention.

FIG. 1 is a simplified, cross-section view of an ignition coil 10 in accordance with the present invention. As is generally known, ignition coil 10 may be coupled to, for example, an ignition system 12, which contains primary energization circuitry for controlling the charging and discharging of ignition coil 10.

Further, also as is well known, the relatively high voltage produced by ignition coil 10 is provided to a spark plug 14 (shown in phantom-line format) for producing a spark across a spark gap thereof, which may be employed to initiate combustion in a combustion chamber of an engine. Ignition system 12, and spark plug 14 perform conventional functions well known to those of ordinary skill in the art.

Ignition coil 10 is adapted for installation to a conventional internal combustion engine through a spark plug well onto a high-voltage terminal of spark plug 14, which is retained by a threaded engagement with a spark plug opening into the above-described combustion cylinder. Ignition coil 10 comprises a substantially slender high voltage transformer including substantially, coaxially arranged primary and secondary windings and a high permeability magnetic core.

Referring to FIG. 1, in accordance with the invention, ignition coil 10 includes a core 16, a secondary winding spool 18, a secondary winding 20, a case 22, potting material 24, a primary winding 26, a shield 28, and a low voltage connector body 30.

Core 16 may be elongated, having a main, longitudinal axis "A" associated therewith. Core 16 includes an upper, first end 31, and a lower, second end 32. Core 16 comprises magnetically permeable material, for example, steel laminations, or, a composite material of ferromagnetic particles, for example, iron, in a binder of electrical insulating material. Core 16 may be a conventional core known to those of ordinary skill in the art, for example, as described and illustrated in U.S. Pat. No. 5,706,792 entitled "INTEGRATED IGNITION COIL AND SPARK PLUG", issued Jan. 13, 1998, hereby incorporated by reference in its entirety. As illustrated, core 16, in the preferred embodiment, takes a generally cylindrical shape.

Secondary winding spool 18 is configured to receive and retain secondary winding 20. Spool 18 is disposed adjacent to and radially outwardly of core 16, and, preferably, in coaxial relationship with core 16. Spool 18 may comprise any one of a number of conventional spool configurations known to those of ordinary skill in the art. In the illustrated embodiment, spool 18 is adapted to be wound in a segmented style configuration. However, it should be understood that spool 18 need not be so configured, and may alternatively be configured to receive one continuous secondary winding, as known.

As illustrated in FIG. 1, spool 18 may include a plurality of axially spaced ribs 34 forming a plurality of channels 36 therebetween. The depth of the respective channels 36 in this embodiment, may decrease from the top of spool 18 (i.e., near the upper end 31 of core 16), to the other end of spool 18, by way of a progressive gradual flare of the spool body. The result of the flare or taper is to increase the distance between secondary winding 20 and primary winding 26, progressively, from the connector-body-end (top) to the spark-plug-end (bottom). As is known in the art, the voltage gradient in the axial direction, which increases toward the spark plug end of the secondary winding, may require increased dielectric insulation between the secondary and primary windings, and, may be provided for by way of the progressively increased separation between the secondary and primary windings. In addition, as will be described in detail hereinafter, the increased separation distance is, in the illustrated embodiment, substantially occupied by epoxy potting material 24, which is a dielectric material that serves the above-described dielectric insulation function.

In addition, the body portion of spool 18 tapers on a lower end thereof to a spark plug connector feature 38. Connector feature 38 includes a generally cylindrical outer surface sized to provide an interference fit with respect to a corresponding through-aperture at the lower end of case 22. In addition, connector feature 38 includes a blind bore or well configured in size and shape to accommodate the size and shape of the high-voltage connector terminal of spark plug 14. Although not shown, spool 18, in the illustrated embodiment, may further include an electrically conductive, high voltage terminal connected between the high voltage end of secondary winding 20 and a contact spring 40 disposed in the blind bore. Contact spring 40 is configured to engage the high-voltage connector terminal of spark plug 14. This arrangement for coupling the high voltage developed by secondary winding 20 to plug 14 is exemplary only; a number of alternative connector arrangements, particularly spring-biased arrangements, are known in the art.

Spool 18 is formed generally of electrical insulating material having properties suitable for use in a relatively high temperature environment. For example, spool 18 may comprise plastic material such as polybutylene terephthalate (PBT) thermoplastic polyester. It should be understood that there are a variety of alternative materials which may be used for spool 18 known to those of ordinary skill in the ignition art, the foregoing being exemplary only and not limiting in nature.

Spool 18 may further include a pair of annular features 44 at axially opposite ends thereof. Features 44 may be configured, although not shown in FIG. 1, so as to engage an inner surface of case 22 to center the core 16/spool 18 assembly in the cavity of case 22.

In a preferred embodiment, a high voltage terminal which connects the high voltage end of secondary winding 20 to contact spring 40, and core 16 are both insert molded into secondary winding spool 18. Technology for insert molding is well known and need not be described in any further detail.

Secondary winding 20, as described above, is wound on spool 18, and includes a low voltage end and a high voltage end. The low voltage end may be connected to ground in a manner to be described hereinafter. The high voltage end is connected to the above-described high voltage terminal disposed in spool 18 for electrically connecting the high voltage generated by secondary winding 20 to contact spring 40 for firing spark plug 14. As known, an interruption of a primary current Ip through primary winding 26, as controlled by ignition system 12, is operative to produce a high voltage at the high voltage end of secondary winding 20. Winding 20 may be implemented using conventional approaches and material known to those of ordinary skill in the art.

Case 22 includes an inner, generally cylindrical surface 46, an outer surface 48, a first annular shoulder 50, a second annular shoulder 52, a third annular shoulder 54, a spacer feature 56, a raceway 58, a through-aperture 60, and a through-bore 62.

Inner surface 46 is configured in size to receive and retain the core 16/spool 18 assembly. The inner surface 46 of case 22 may be slightly spaced from spool 18, particularly the annular spacing features 44 thereof (as shown), or may engage the spacing features 44 of spool 18.

Annular shoulders 50, and 52 are located near upper, and lower ends of case 22, respectively. The primary winding 26 is wound on a portion of outer surface 48 that is intermediate the upper and lower annular shoulders 50, and 52. Annular shoulders 50, and 52, in conjunction with annular shoulder 54, and spacer feature 56, are configured to space shield 28 a predetermined distance apart from primary winding 26.

Raceway 58 is provided for carrying leads from the first and second ends of primary winding 26 to the low voltage connector body 30.

Aperture 60 is configured in size and shape (i.e., generally cylindrical) to provide an interference fit with an outer surface of connector feature 38, described above. When connector feature 38 is inserted in aperture 60, therefore, a seal is made.

Bore 62 is provided to accept a conventional fastener to secure ignition coil 10 to an internal combustion engine (not shown).

Case 22 is formed of electrical insulating material, and may comprise conventional materials known to those of ordinary skill in the art (e.g., the PBT thermoplastic polyester material referred to above).

Potting material 24 preferably comprises epoxy potting material which is introduced into a potting channel defined between inner surface 46 of case 22, and, among other things, the secondary winding 20. The potting channel is filled with potting material 24, in the illustrated embodiment, up to approximately the level indicated by the potting level 64. The potting material performs the function of electrical insulation between the secondary winding 20 and other electrically conductive components (e.g., primary winding 26), and, provides protection from environmental factors which may be encountered during the service life of ignition coil 10. There are a number of suitable epoxy potting materials well know to those of ordinary skill in the art.

Primary winding 26 includes first and second ends and is configured to carry a primary current IP for charging coil 10 upon control of ignition system 12. Winding 26 may be implemented using known approaches and conventional materials.

Shield 28 is generally annular in shape and is disposed radially outwardly of primary winding 26, and, preferably, is spaced a predetermined distance therefrom. The shield 28 is preferably electrically conductive, and more preferably metal, such as steel or other adequate magnetic material. Shield 28 provides not only a protective barrier for ignition coil 10 generally, and primary winding 26 in particular, but, further, provides a magnetic path for the magnetic circuit portion of ignition coil 10. Shield 28 may be grounded.

Low voltage connector body 30 is configured to electrically connect the first and second ends of primary winding 26 to an energization source, such as, the energization circuitry included in ignition system 12. Connector body 30 is generally formed of electrical insulating material, but also includes a plurality of electrically conductive output terminals (e.g., pins). As illustrated in diagrammatic form, leads 66 are coupled from the ends of primary winding 26 to connector body 30, which are then internally routed through body 30 via electrical conductors to predetermined ones of the output terminals (e.g., pins). Ignition system 12 may then control energization of the primary winding 26. In addition, also illustrated in diagrammatic form, connector body 30 includes a ground terminal 68, which is also electrically routed through body 30 to a predetermined one of the output terminals thereof. From ground terminal 68 may be electrically connected to (i) the low voltage end of secondary winding 20, and (ii) shield 28, to provide the respective ground connections described above.

In accordance with the present invention, ignition coil 10 only includes one "potting" channel (i.e., between secondary winding 20 and inner surface 46 of case 22), thus eliminating the second potting channel found in conventional ignition coil designs. This elimination improves the potting process portion of the coil assembly. In addition, the inventive configuration of case 22 eliminates the need for a primary winding spool, thus reducing the cost of ignition coil 10 (i.e., no cost for the primary spool). Eliminating the spool for the primary winding also provides increased space in the same package size for more winding turns (or increased core material) for improved ignition coil performance. In addition, elimination of the primary spool also eliminates a principal dielectric barrier that is found in conventional configurations. As shown in FIG. 1, only the wall of case 22, and the wall of spool 18 are principal dielectric barriers. The minimized capacitance yields improved secondary voltage performance.

It is to be understood that the above description is merely exemplary rather than limiting in nature, the invention being limited only by the appended claims. Various modifications and changes may be made thereto by one of ordinary skill in the art which embody the principles of the invention and fall within the spirit and scope thereof.

What is claimed is:

1. An ignition coil for producing a spark across a gap of a spark plug, said coil comprising:

a core having opposing first and second ends, said core having a longitudinal axis associated therewith and comprising magnetically-permeable material;

a secondary winding spool disposed adjacent to and radially outwardly of said core, said spool having a connector feature at a first axial end thereof configured to accommodate a connector terminal of the spark plug, said spool further having a high voltage terminal disposed therein, said high voltage terminal being electrically connected to a contact spring proximate said connector feature, said contact spring being configured to engage the connector terminal of the spark plug;

a secondary winding wound on said spool, said secondary winding having a low voltage end and a high voltage end connected to the high voltage terminal;

a case disposed radially outwardly of said spool and comprising electrical insulating material, said case having an inner surface and an outer surface, said case further including an upper annular shoulder and a lower annular shoulder;

potting material disposed between said inner surface of said case and said secondary winding;

a primary winding wound on a portion of said outer surface of said case intermediate said upper and lower annular shoulders, said primary winding including first and second ends;

an annular shield disposed radially outwardly of said primary winding, said shield comprising metallic material; and, a connector body comprising electrical insulating material and comprising a plurality of output terminals, said low voltage end of said secondary winding and said first and second ends of said primary winding being electrically connected to said plurality of output terminals.

2. The ignition coil of claim 1 wherein said core is insert molded into said secondary winding spool.

3. An ignition coil comprising:

a core having opposing first and second ends, said core having a longitudinal axis associated therewith and comprising magnetically-permeable material;

a secondary winding spool disposed adjacent to and radially outwardly of said core;

a secondary winding wound on said spool;

a case disposed radially outwardly of said spool and comprising electrical insulating material, said case having an inner surface and an outer surface, said case including a cavity for receiving said core, said spool, and said secondary winding, said case further including a portion extending radially outwardly at an upper axial end of said coil and having a bore provided to accept a fastener to secure said ignition coil;

potting material disposed between said inner surface of said case and said secondary winding;

a primary winding wound on said outer surface of said case; and a shield disposed radially outwardly of said primary winding, said shield comprising metallic material.

4. The ignition coil of claim 3 further comprising a connector body configured to electrically connect first and second ends of said primary winding to an energization source.

5. The ignition coil of claim 4 wherein said connector body is further configured to electrically connect a first end of said secondary winding to a ground node.

6. The ignition coil of claim 3 wherein said core is insert molded into said secondary winding spool.

7. The ignition coil of claim 3 wherein said core comprises ferromagnetic particles in a binder of electrical insulating material.

8. The ignition coil of claim 3 wherein said case includes an upper annular shoulder and a lower annular shoulder, said primary winding being wound on a portion of said outer surface intermediate said upper and lower annular shoulders.

9. The ignition coil of claim 3 wherein said potting material comprises epoxy potting materials.

* * * * *